US011418013B1

(12) United States Patent
Yang

(10) Patent No.: US 11,418,013 B1
(45) Date of Patent: Aug. 16, 2022

(54) SPARK PLUG

(71) Applicants: HYUNDAI MOTOR COMPANY, Seoul (KR); KIA CORPORATION, Seoul (KR)

(72) Inventor: Il Suk Yang, Hwaseong-si (KR)

(73) Assignees: HYUNDAI MOTOR COMPANY, Seoul (KR); KIA CORPORATION, Seoul (KR)

( * ) Notice: Subject to any disclaimer, the term of this patent is extended or adjusted under 35 U.S.C. 154(b) by 0 days.

(21) Appl. No.: 17/544,302

(22) Filed: Dec. 7, 2021

(30) Foreign Application Priority Data

Jun. 24, 2021 (KR) ..... 10-2021-0082172

(51) Int. Cl.
*H01T 13/54* (2006.01)

(52) U.S. Cl.
CPC ..... *H01T 13/54* (2013.01)

(58) Field of Classification Search
CPC ..... H01T 13/54
USPC ..... 313/143
See application file for complete search history.

(56) References Cited

U.S. PATENT DOCUMENTS 1,596,240 A * 8/1926 Dikeman ..... F02P 13/00 123/169 PA
1,788,661 A * 1/1931 Dikeman ..... H01T 13/54 313/143

* cited by examiner

*Primary Examiner* — Christopher M Raabe
(74) *Attorney, Agent, or Firm* — McDonnell Boehnen Hulbert & Berghoff LLP

(57) ABSTRACT

A spark plug is disclosed. A spark plug according to an exemplary embodiment of the present disclosure may include a main body including an electrode body formed with a center electrode and a moving chamber formed, wherein the moving chamber formed between the center electrode and the main body, a cap portion fixedly installed in the main body, formed with a pre-combustion chamber fluidly communicated with the moving chamber, formed with a ground electrode that is disposed to be spaced apart from the center electrode by a predetermined distance, and formed with a plurality of communication hole; a separation wall movably provided along the electrode body, and an elastic member providing an elastic force to the separation wall.

12 Claims, 10 Drawing Sheets

Intake stroke

Compression stroke

Explosion stroke

Exhaust stroke

SPARK PLUG

CROSS-REFERENCE TO RELATED APPLICATION

This application claims priority to and the benefit of Korean Patent Application No. 10-2021-0082172 filed in the Korean Intellectual Property Office on Jun. 24, 2021, the entire contents of which are incorporated herein by reference.

BACKGROUND

(a) Field

The present disclosure relates to a spark plug. More particularly, the present disclosure relates to a spark plug including a pre-combustion chamber.

(b) Description of the Related Art

In general, when a mixture of fuel and air is combusted inside a combustion engine, a nitrogen oxide (NOx) is formed.

The amount of the nitrogen oxide increases according to an increase in a combustion temperature, but the amount of the nitrogen oxide may be decreased by increasing a mixing ratio of the fuel and the air, that is, using a further diluted fuel mixture.

However, when the mixing ratio of the fuel and the air is increased, the fuel inside the engine may be incompletely combusted.

In order to improve efficiency of incomplete combustion, a lean burn engine employs a pre-combustion chamber.

A relatively enriched mixture gas of fuel and air is supplied to the pre-combustion chamber, and the mixture gas is ignited and then flame thereof is spread to the combustion chamber, so that the relatively diluted mixture of fuel and air is combusted inside the combustion chamber.

A flow of the mixture gas flowing into the pre-combustion chamber and a residual gas exhausted from the pre-combustion chamber after combustion is achieved by pressure and flow of a main combustion chamber fluidly communicated with the pre-combustion chamber. At this time, since the flow of the mixture gas and the residual gas is made only until pressure equilibrium between the main combustion chamber and the pre-combustion chamber is reached, there is a problem that an inflow and an exhaust of the mixture gas and the residual gas are not facilitated.

Due to this, since enriched mixture gas flowing into the pre-combustion chamber from the main-combustion chamber is limited, it is difficult to obtain sufficient flame when the mixture gas is ignited by a spark plug.

Furthermore, since the residual gas in the pre-combustion chamber is not sufficiently exhausted to the main-combustion chamber, the ignition in the next stroke is not facilitated due to the residual gas remaining in the pre-combustion chamber.

The above information disclosed in this Background section is only for enhancement of understanding of the background of the disclosure, and therefore it may contain information that does not form the prior art that is already known in this country to a person of ordinary skill in the art.

SUMMARY

The present disclosure has been made in an effort to provide a spark plug that can allow sufficient mixture gas to inflow into a pre-combustion chamber and sufficiently scavenge a residual gas inside the pre-combustion chamber.

A spark plug according to an exemplary embodiment of the present disclosure may include a main body including an electrode body formed with a center electrode and a moving chamber formed, wherein the moving chamber formed between the center electrode and the main body, a cap portion fixedly installed in the main body, formed with a pre-combustion chamber fluidly communicated with the moving chamber, formed with a ground electrode that is disposed to be spaced apart from the center electrode by a predetermined distance, and formed with a plurality of communication hole; a separation wall movably provided along the electrode body, and an elastic member providing an elastic force to the separation wall.

The cap portion may include a first portion formed as a hemisphere shape, and a second portion extended from the first portion and engaged with the main body.

The ground electrode may be protruded and formed in a lower center of the first portion.

The communication holes may be formed in the first portion at the same interval in a circumferential direction.

The communication holes may be formed toward the center electrode.

The main body and the second portion of the cap portion may be engaged with each other by welding.

The separation wall may have as a ring shape.

The elastic member may provide the elastic force in a direction in which the separation wall faces the center electrode.

The elastic member may be a compression coil spring.

The spark plug according to an exemplary embodiment of the present disclosure may further include a stopper provided between the cap portion and the main body, and limiting a moving distance of the separation wall.

The stopper may be seated on a seating groove formed in an inner surface of the cap portion.

A volume of the moving chamber communicated with the pre-combustion chamber may be varied by a movement of the separation wall.

According to an exemplary embodiment of the present disclosure, as the separation wall moves in a vertical direction by the internal pressure of the pre-combustion chamber and the elastic force of the elastic member applied to the separation wall, the amount of the mixture gas inflow from the main-combustion chamber to the pre-combustion chamber is increased, thereby minimizing the amount of the residual gas discharged from the pre-combustion chamber to the main-combustion chamber.

BRIEF DESCRIPTION OF THE DRAWINGS

The drawings are intended to be used as references for describing the exemplary embodiments of the present disclosure, and the accompanying drawings should not be construed as limiting the technical spirit of the present disclosure.

DETAILED DESCRIPTION OF THE EMBODIMENTS

Figure 1:
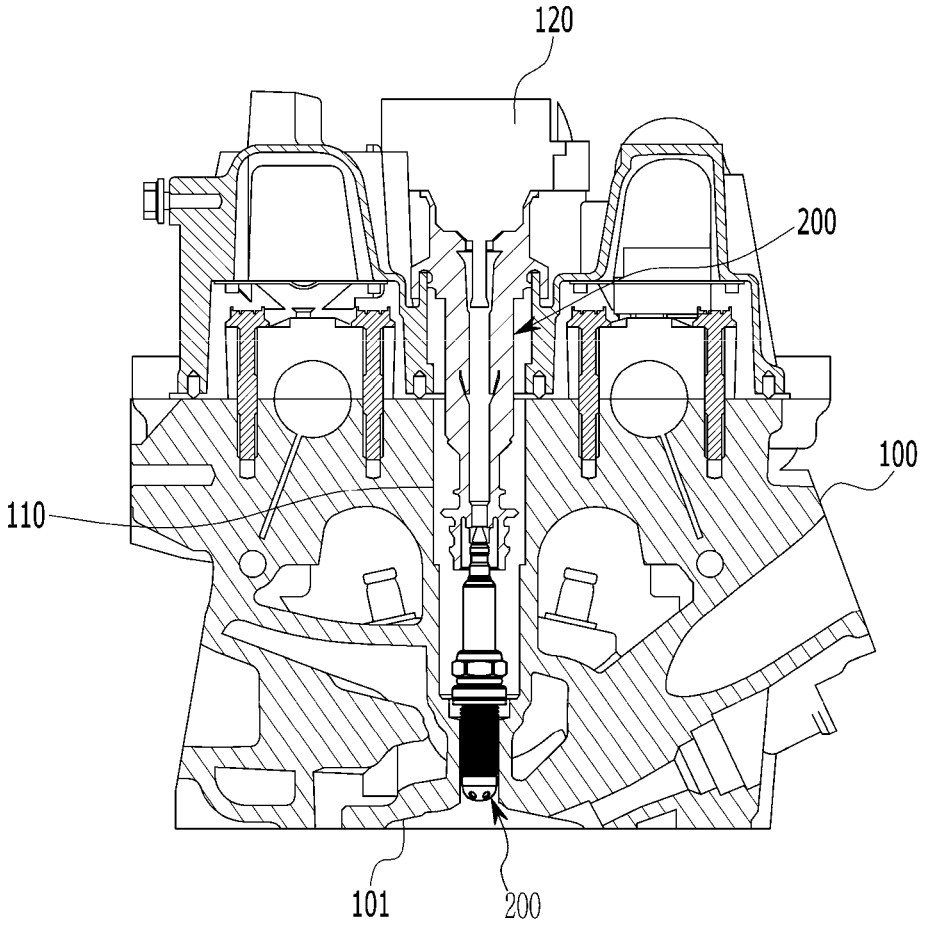
FIG. 1 shows a cross-sectional view illustrating an engine on which a spark plug is mounted according to an exemplary embodiment of the present disclosure.

The present disclosure will be described more fully hereinafter with reference to the accompanying drawings, in which exemplary embodiments of the disclosure are shown. As those skilled in the art would realize, the described embodiments may be modified in various different ways, all without departing from the spirit or scope of the present disclosure.

Accordingly, the drawings and description are to be regarded as illustrative in nature, and not restrictive. Like reference numerals designate like elements throughout the specification.

In addition, since the sizes and thickness of each of constituent elements in drawings is randomly shown for the convenience of explanation, the present disclosure illustrated in the drawings is not limited to thereof and several portions and regions may be exaggerated for clarity.

Hereinafter, a spark plug according to an exemplary embodiment of the present disclosure will be described in detail with reference to accompanying drawings. First, an engine applied with the spark plug 200 according to an exemplary embodiment of the present disclosure will be described in detail with reference to accompanying drawings.

FIG. 1 shows a cross-sectional view illustrating an engine on which a spark plug is mounted according to an exemplary embodiment of the present disclosure.

As shown in FIG. 1, the engine applied with the spark plug 200 according to an exemplary embodiment of the present disclosure may include a cylinder block and a cylinder head.

The cylinder block and the cylinder head 100 are combined to form a main-combustion chamber 101 therein. A mixture gas of air and fuel inflowing into the main-combustion chamber 101 is ignited by spark discharge generated by the spark plug 200.

In the cylinder head 100, a mount hole 110 in which the spark plug 1 is mounted is vertically formed long. A lower portion of the spark plug 1 that is mounted in the mount hole 110 protrudes into the main-combustion chamber 101.

An ignition coil 120 is mounted on an upper portion of the mount hole 110, and the ignition coil 120 supplies high voltage current to the spark plug 200.

Next, the spark plug 200 according to an exemplary embodiment of the present disclosure will be described in detail with reference to accompanying drawings.

Figure 2:
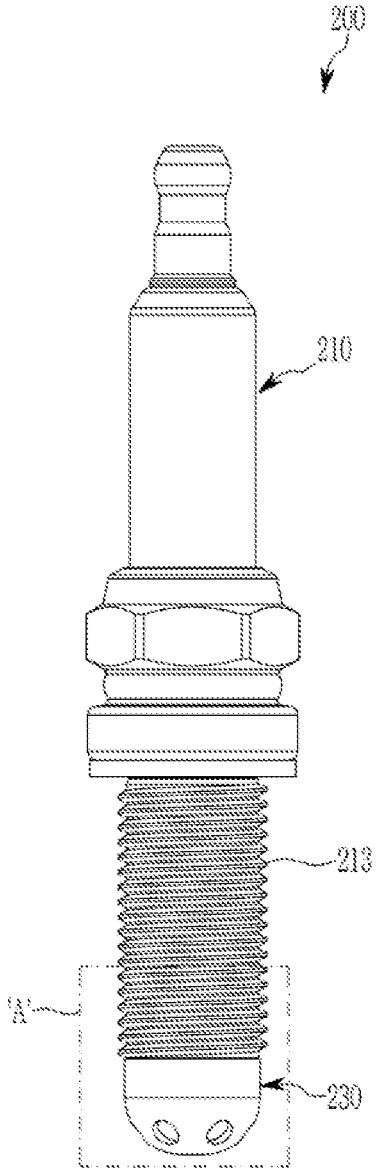
FIG. 2 shows a top plan view illustrating a spark plug according to an exemplary embodiment of the present disclosure.
Figure 3:
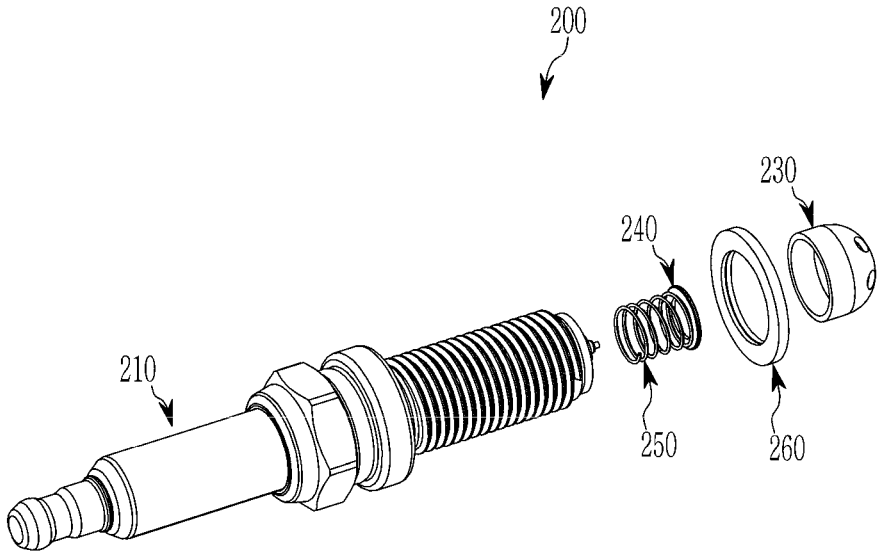
FIG. 3 shows an exploded perspective view illustrating a spark plug according to an exemplary embodiment of the present disclosure.

FIG. 2 shows a top plan view illustrating a spark plug according to an exemplary embodiment of the present disclosure. FIG. 3 shows an exploded perspective view illustrating a spark plug according to an exemplary embodiment of the present disclosure. In addition, FIG. 4 shows a cross-sectional view of 'A' of FIG. 1.

Figure 4:
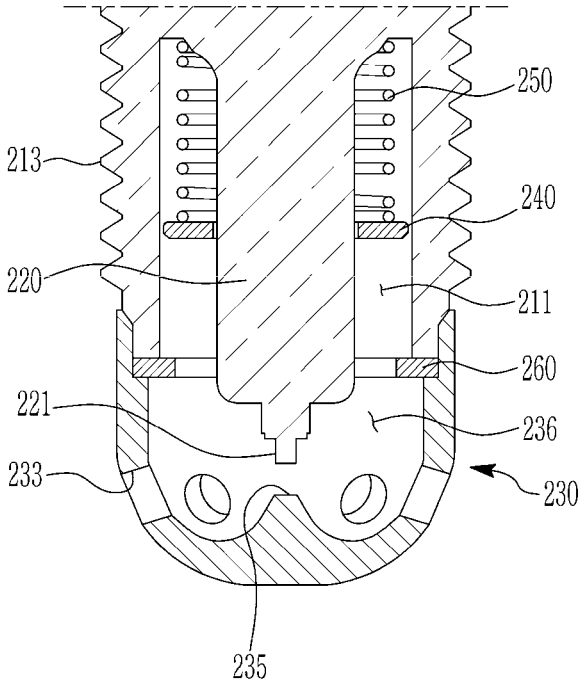
FIG. 4 shows a cross-sectional view of 'A' of FIG. 1.

As shown in FIG. 2 to FIG. 4, the spark plug 200 according to an exemplary embodiment of the present disclosure includes a main body 210 provided with center electrode 221, and a cap portion 230 coupled with the main body 210 and formed with a ground electrode 235.

The main body 210 is formed in a long cylinder shape in a vertical direction. An electrode body 220 formed with the center electrode 221 is provided inside the main body 210, and a moving chamber 211 is formed between the electrode body 220 and the main body 210.

The electrode body 220 of the main body 210 is electrically connected to the ignition coil 120, and receives a high voltage current from the ignition coil 120.

A thread is formed on an exterior circumference of the main body 210. The main body 210 is screw-engaged with the mount hole 110 of the cylinder head 100. In detail, a thread formed in the main body 210 of the spark plug 200 and a thread 213 formed in the mount hole 110 are screw-engaged with each other, so that the spark plug 200 is coupled to the mount hole 110 of the cylinder head 100.

The cap portion 230 is fixedly positioned on the main body 210, and a pre-combustion chamber 236 is formed therein. The cap portion 230 may be fixedly coupled to the main body 210.

Figure 5:
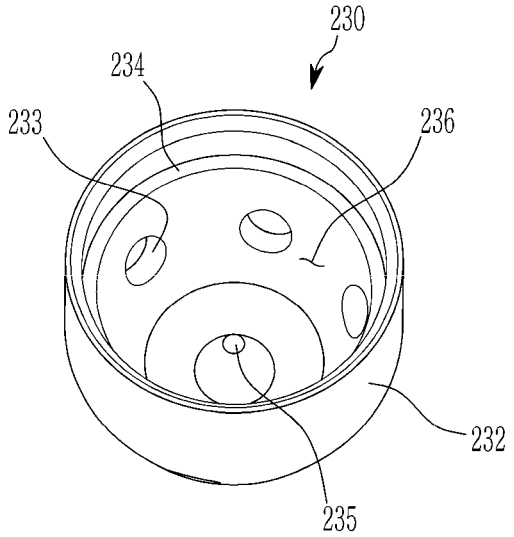
FIG. 5 shows a perspective view illustrating a cap portion according to an exemplary embodiment of the present disclosure.

FIG. 5 shows a perspective view illustrating a cap portion according to an exemplary embodiment of the present disclosure. In addition, FIG. 6 shows a cross-sectional view illustrating a cap portion according to an exemplary embodiment of the present disclosure.

Figure 6:
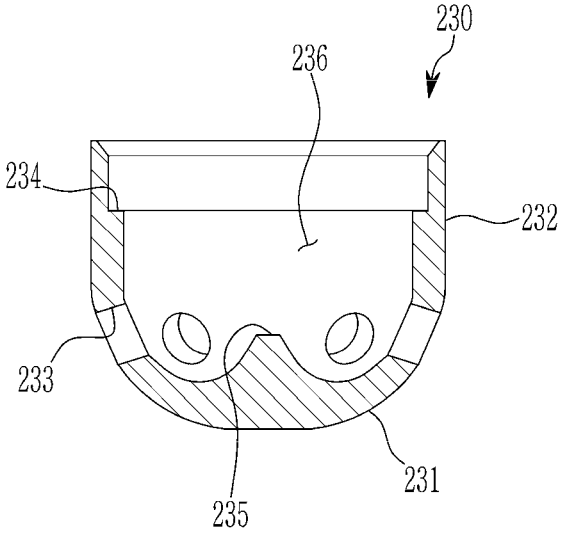
FIG. 6 shows a cross-sectional view illustrating a cap portion according to an exemplary embodiment of the present disclosure.

Referring to FIG. 5 and FIG. 6, the cap portion 230 may include a first portion 231, and a second portion 232 extending from the first portion 231 and engaged with the main body 210. The first portion 231 may have a hemisphere shape, and the second portion 232 may have a cylinder shape.

The second portion 232 of the cap portion 230 may be coupled to the main body 210 through laser welding.

A ground electrode 235 is protruded and formed in a lower center of the first portion 231 of the cap portion 230, and the ground electrode 235 is spaced apart from the center electrode 221 of the main body 210 by a predetermined distance.

A plurality of communication hole 233 are formed in the first portion 231 of the hemisphere shape at the same interval in a circumferential direction. The communication holes 233 are formed toward the center electrode 221 of the main body 210. The pre-combustion chamber 236 fluidly communicates with a main-combustion chamber through the communication holes 233.

A seating groove 234 in which a stopper 260 to be described in later is seated is formed on in inner surface of the second portion 232.

Referring back to FIG. 2 to FIG. 4, a separation wall 240 is movably positioned in the moving chamber 211 of the main body 210. In detail, the separation wall 240 may be movable along the electrode body 220 of the main body 210. The separation wall 240 may be have a ring shape. As the separation wall 240 moves in the vertical direction along the electrode body 220, a volume of moving chamber 211 is varied. For example, the volume of the moving chamber 211 is increased when the separation wall 240 moves in an upward direction, and the volume of the moving chamber 211 is decreased when the separation wall 240 moves in a downward direction.

Accordingly, the pre-combustion chamber 236 formed in the cap portion 230 and the moving chamber 211 formed in the main body 210 cooperate to obtain an effect that the volume of the pre-combustion chamber 236 is varied.

An elastic member 250 in which supplies elastic force to the separation wall 240 is positioned in the moving chamber 211 of the main body 210. The elastic member 250 may provide the elastic force in the direction in which the separation wall 240 faces the center electrode 221 (e.g., downward direction based on FIG. 4). For this, the elastic member 250 may be realized through a compression coil spring.

The elastic member 250 may be fixedly positioned in the separation wall 240. For example, an end portion of the elastic member 250 may be fixed to an upper surface of the separation wall 240 by welding.

Meanwhile, a stopper for limiting a moving distance of the separation wall 240 may be provided between the cap portion 230 and the main body 210. The stopper 260 may include a stopper body having a ring shape, and a stopper hole formed in a center of the stopper body. An inner side of the stopper hole is spaced apart from an exterior circumference of the electrode body 220 by a predetermined distance.

A lower surface of the stopper 260 is seated on the seating groove 234 formed in the inner surface of the second portion 232 of the cap portion 230, and an upper surface of the stopper 260 is in contact with a lower end of the main body 210. Accordingly, the stopper 260 is positioned between the seating groove 234 formed in the second portion 232 of the cap portion 230 and the lower end of the main body 210.

The separation wall 240 may only move from the center electrode 221 to a predetermined position.

Hereinafter, an operation of the spark plug 200 according to an exemplary embodiment of the present disclosure will be described in detail with reference to accompanying drawings.

Figure 7:
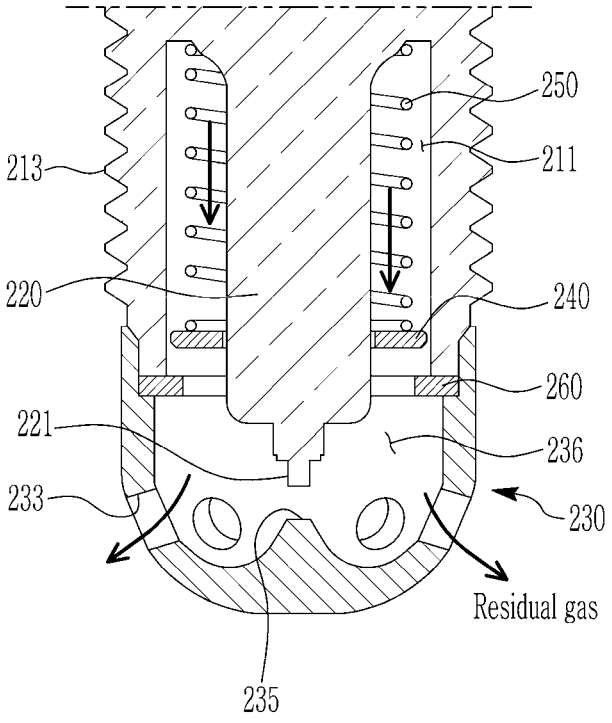
FIG. 7 shows a drawing for explaining an operation of a spark plug in a suction stroke according to an exemplary embodiment of the present disclosure.
Figure 8:
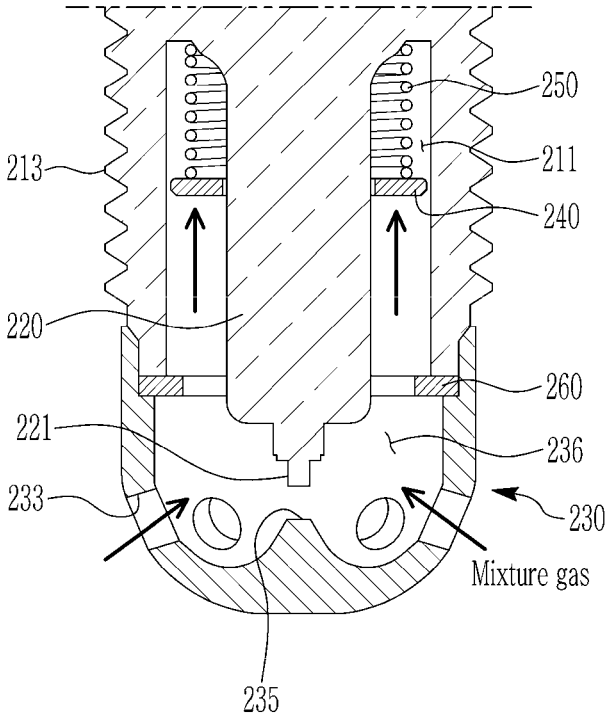
FIG. 8 shows a drawing for explaining an operation of a spark plug in a compression stroke according to an exemplary embodiment of the present disclosure.
Figure 9:
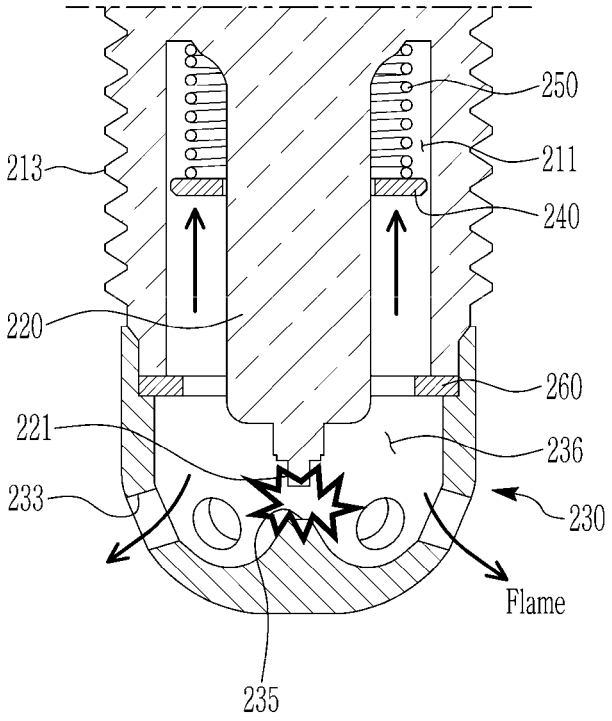
FIG. 9 shows a drawing for explaining an operation of a spark plug in an explosion stroke according to an exemplary embodiment of the present disclosure.
Figure 10:
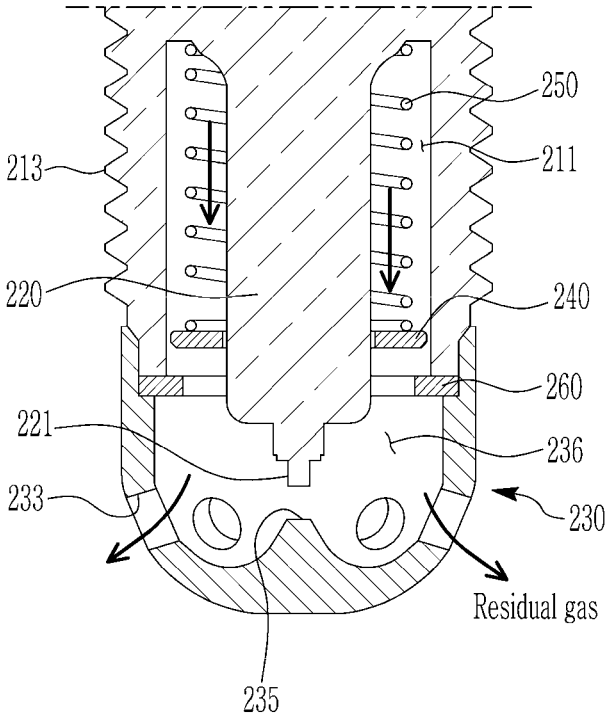
FIG. 10 shows a drawing for explaining an operation of a spark plug in an exhaust stroke according to an exemplary embodiment of the present disclosure.

FIG. 7 shows a drawing for explaining an operation of a spark plug in a suction stroke according to an exemplary embodiment of the present disclosure. FIG. 8 shows a drawing for explaining an operation of a spark plug in a compression stroke according to an exemplary embodiment of the present disclosure. FIG. 9 shows a drawing for explaining an operation of a spark plug in an explosion stroke according to an exemplary embodiment of the present disclosure. In addition, FIG. 10 shows a drawing for explaining an operation of a spark plug in an exhaust stroke according to an exemplary embodiment of the present disclosure.

Referring to FIG. 7, as a negative pressure is formed inside the main-combustion chamber during the suction stroke, the pressure inside the pre-combustion chamber 236 is also lowered. Accordingly, the separation wall 240 moves to the lowest position in the moving chamber 211 by the elastic force of the elastic member 250.

At this time, due to the pressure difference between an internal pressure of the pre-combustion chamber 236 and an internal pressure of the main-combustion chamber, a flow from the pre-combustion chamber 236 to the main-combustion chamber is formed, and a residual gas inside the pre-combustion chamber 236 moves to the main-combustion chamber through the communication hole 233. Accordingly, the residual gas inside the pre-combustion chamber 236 may be minimized.

Referring to FIG. 8, as the internal pressure inside the main-combustion chamber is increased in the compression stroke, the internal pressure inside the pre-combustion chamber 236 is also increased. Accordingly, due to the difference between the pressure applied to the separation wall 240 and the elastic force of the elastic member 250, the separation wall 240 moves in the upward direction, and the mixture gas (e.g., fuel and external air) inflows to the pre-combustion chamber 236 from the main-combustion chamber through the communication holes 233.

At this time, as the separation wall 240 moves in the upward direction, the volume of the moving chamber 211 fluidly communicated with the pre-combustion chamber 236 is increased, thus the volume of the pre-combustion chamber 236 is increased. Therefore, the flow of the mixture gas from the main-combustion chamber to the pre-combustion chamber 236 is enhanced, and the amount of the mixture gas flowing into the pre-combustion chamber 236 is increased.

Referring to FIG. 9, a spark discharger between the center electrode 221 and the ground electrode 235 is generated in the explosion stroke, and the mixture gas is ignited by the spark discharge. At this time, the flame generated by the spark discharge between the center electrode 221 and the ground electrode 235 is discharged to the main-combustion chamber through the plurality of communication hole 233 formed in the cap portion 230, and the flame is gradually spread.

In addition, as the internal pressure of the pre-combustion chamber 236 is increased, the separation wall 240 moves to the uppermost position in the moving chamber 211.

Referring to FIG. 10, the internal pressure of the pre-combustion chamber 236 is decreased as the internal pressure of the main-combustion chamber is decreased in the exhaust stroke, and the separation wall 240 moves in the downward direction by the elastic force of the elastic member 250. As the separation wall 240 moves in the downward direction, the volume of the moving chamber 211 communicated with the pre-combustion chamber 236 is also decreased. Accordingly, the residual gas inside the pre-combustion chamber 236 is exhausted to the main-combustion chamber as possible through the communication holes 233.

As described above, according to an exemplary embodiment of the present disclosure, as the separation wall 240 moves in a vertical direction by the internal pressure of the pre-combustion chamber 236 and the elastic force of the elastic member applied to the separation wall 240, the amount of the mixture gas inflow from the main-combustion chamber to the pre-combustion chamber 236 is increased, thereby minimizing the amount of the residual gas discharged from the pre-combustion chamber 236 to the main-combustion chamber.

In addition, as the amount of the mixture gas flowing into the pre-combustion chamber 236 from the main-combustion chamber is increased, the ignition force in the explosion stroke is increased, and flame propagation force to the main-combustion chamber is increased, thereby improving combustion efficiency.

Further, since the ground electrode 235 is positioned in the center of the cap portion 230 and there is no need to form an additional tip portion corresponding to the ground electrode of the present disclosure, the flow resistance of the mixture gas (or residual gas) by the combustion inside the pre-combustion chamber 236 is minimized, and diffusion of the mixture gas (or residual gas) is facilitated, thereby improving combustion efficiency.

Further, since the pre-combustion chamber 236 and the moving chamber 211 fluidly communicate with each other and the volume of the moving chamber 211 is varied, the amount of the mixture gas flowing into the pre-combustion chamber 236 is increased, and the flame amount caused by the spark discharge is increased, thus the flame energy inflow into the main-combustion chamber is increased.

Further, since the separation wall 240 moves to the lowest position in the moving chamber in the suction stroke and the exhaust stroke, the pre-combustion chamber 236 maintains a minimum volume and the residual gas inside the pre-combustion chamber 236 may be minimized.

Further, since the flame energy is increased inside the pre-combustion chamber 236, propagation energy of the flame and the combustion efficiency are increased so that knocking is suppressed and the ignition timing may be advanced.

<While this disclosure has been described in connection with what is presently considered to be practical exemplary embodiments, it is to be understood that the disclosure is not limited to the disclosed embodiments. On the contrary, it is intended to cover various modifications and equivalent arrangements included within the spirit and scope of the appended claims.

What is claimed is:

1. A spark plug comprising:

a main body including an electrode body formed with a center electrode and a moving chamber, wherein the moving chamber is positioned between the center electrode and the main body;

a cap portion fixedly positioned in the main body, wherein the cap portion is formed with a pre-combustion chamber that fluidly communicate with the moving chamber, and wherein the cap portion is formed with a ground electrode that is spaced apart from the center electrode by a predetermined distance, and wherein the cap portion is formed with a plurality of communication holes;

a separation wall movably provided along the electrode body; and an elastic member providing an elastic force to the separation wall.

2. The spark plug of claim 1, wherein the cap portion includes:

a first portion having a hemisphere shape; and a second portion extending from the first portion and engaged with the main body.

3. The spark plug of claim 2, wherein the ground electrode protrudes from and formed in a lower center of the first portion.

4. The spark plug of claim 2, wherein the plurality of communication holes are formed in the first portion at equal intervals in a circumferential direction.

5. The spark plug of claim 2, wherein the plurality of communication holes are formed toward the center electrode.

6. The spark plug of claim 2, wherein the main body and the second portion of the cap portion are welded together.

7. The spark plug of claim 1, wherein the separation wall has a ring shape.

8. The spark plug of claim 1, wherein the elastic member provides the elastic force in a direction in which the separation wall faces the center electrode.

9. The spark plug of claim 8, wherein the elastic member is a compression coil spring.

10. The spark plug of claim 1, further comprising:

a stopper positioned between the cap portion and the main body, wherein the stopper limits a moving distance of the separation wall.

11. The spark plug of claim 10, wherein the stopper is seated on a seating groove formed in an inner surface of the cap portion.

12. The spark plug of claim 1, wherein a volume of the moving chamber communicating with the pre-combustion chamber is varied by a movement of the separation wall.

* * * * *